US007901296B1

(12) United States Patent
Cayse

(10) Patent No.: US 7,901,296 B1
(45) Date of Patent: Mar. 8, 2011

(54) GOLF SWING TRAINING APPARATUS

(76) Inventor: Raymond T. Cayse, Woodland Hills, CA (US)

( * ) Notice: Subject to any disclaimer, the term of this patent is extended or adjusted under 35 U.S.C. 154(b) by 0 days.

(21) Appl. No.: 12/803,915

(22) Filed: Jul. 8, 2010

(51) Int. Cl.
*A63B 69/36* (2006.01)

(52) U.S. Cl. ..... 473/257; 473/219

(58) Field of Classification Search ..... 473/219, 473/226, 228, 231, 232, 257, 422
See application file for complete search history.

(56) References Cited

U.S. PATENT DOCUMENTS

| | | | | |
|---|---|---|---|---|
| 5,165,685 | A * | 11/1992 | Hynes | 473/597 |
| 5,195,748 | A * | 3/1993 | Koch et al. | 473/232 |
| 5,338,035 | A * | 8/1994 | Lyford | 473/232 |
| 5,634,857 | A * | 6/1997 | Bradshaw et al. | 473/238 |
| 7,351,157 | B2 * | 4/2008 | Priester et al. | 473/228 |

* cited by examiner

*Primary Examiner* — Nini Legesse
(74) *Attorney, Agent, or Firm* — James E. Brunton

(57) ABSTRACT

A training apparatus that instructs a trainee in the two optimum golf swings, namely an inward swing method and an outward swing. The apparatus is uniquely constructed so that during use the trainee can positively feel the differences between the inward golf swing and the outward golf swing. The apparatus is of a simple, compact construction and can be used by the trainee either indoors or outdoors.

11 Claims, 9 Drawing Sheets

GOLF SWING TRAINING APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates generally to golf swing training apparatus. More particularly, the invention concerns an apparatus for instructing a trainee in two golf swings, namely an inward swing and an outward swing.

2. Description of Related Art Including Information Disclosed Under 37 CFR 1.97 and 1.98

It is generally agreed that there are two mutually exclusive and equally effective optimum golf swings, namely the so-called "inward" golf swing and the so-called "outward" golf swing. It is also generally agreed that the golf swing embodies two separate applications of geometry, both of which must be properly addressed in an effective golf swing. The first of these, namely "impact geometry", concerns the fact that one must compress the ball on the face of the club-head in such a manner that maximum swing force is transferred.

Accomplishing this without side spin is the ideal, but most accomplished golfers use either a 'draw' spin or a 'fade' spin in carrying out the majority of their shots.

The other application of geometry, namely "force controlling geometry", produces the physics that controls the transfer of the total swing force to the club-head. Most good golfers develop a feel for an effective swing through a trial and error method ("muscle memory") that is inconsistent at best. Adding to the difficulty with this approach is the fact that there are two diametrically opposed procedures for effectively releasing the club-head, each with its own unique feel. Mostly because of this fact, contradictory advice has always plagued the game; more often by being incomplete, rather than totally wrong. The forgoing and various other theories concerning the golf swing have been discussed in numerous books and articles, including books by Ben Hogan and Homer Kelley.

Ben Hogan, in his noted work, *Five Lessons: The Modern Fundamentals of Golf*, likened the swing plane to a large flat pane of glass inclined from the intended line of flight of the ball and generally resting on the shoulders of the trainee. In Hogan's theory, the glass pane intersected the ground in a line which was coincident with the line of flight. To control club movement, the golfer ideally swung the club-head underneath the plane throughout the swing. However, Hogan introduced a slight shift in the plane line in the downswing to account for the apparent motion of the club-head outward and away from the golfer from hip height through impact.

Homer Kelley in his well known book, *The Golfing Machine*, describes the swing plane as a two-dimensional geometric structure on which the entire club moves throughout the golf swing. Kelley pictured the swing plane as a flat pane of glass intersecting the ground in a line with the plane line being identical with the intended initial line of flight of the ball. This plane was described by Kelley as having a dynamically changing, inclined angle during the swing, with the entire club remaining on the plane throughout the swing.

Kelley mentions in his book that, depending on the number of 'accumulators' used, that is, parts of his 'power package', a golf swing can be anything from a simple "one barrel" to a full "four barrel" version.

The inward and outward swings, which are taught to be recognized by the trainee through the use of the apparatus of the present invention, can be explained in terms of the Kelley concepts as follows: Basically, there are five basic elements of the golf swing: the lower body (hips), the upper body (shoulders), the leading arm, the hands, and the shaft flex. These five elements are released in the sequence listed in the downswing of each swing method. However, each element has the potential to release in either direction, that is, inward or outward. As such, they have the capacity to create torque four times by opposing each other in sequential fashion. It is these four potential segments of torque that actually establish the number of 'barrels' a swing contains and, thereby, its ability to create effortless power.

In performing the golf swing, each of the five basic elements of the golf swing element is indirectly affected by each of the others. For example, the hips are outward when they are adding to the turning force of the swing through impact and they are inward when they are resisting this force. The shoulders act similarly, but must act in an opposite direction to the hips for a four barrel swing to result. The leading arm is outward when the angle formed by it and the shoulders is increasing (Kelley's #4 accumulator); and it is inward when this angle is decreasing through impact. The action of the hands and club shaft are similar to the action of the hips and shoulders.

The importance of understanding and being able to recognize the two swing methods discussed in the preceding paragraphs is highlighted by the fact that while most touring professionals are inward swingers, there are some notable exceptions including Jack Nicklaus, Greg Norman, Fred Couples and John Daly. Examples of renowned inward swingers include Arnold Palmer, Lee Trevino, Steve Elkington and Nick Faldo.

Teachers of golf and authors of books and articles on the golf swing almost always fall into one category or the other. For example, Ben Hogan's *Five Lessons: The Modern Fundamentals of Golf*, tends to favor the inward swing, while Leslie King's *Masterkey to Good Golf*, tends to favor the outward swing.

BRIEF SUMMARY OF THE INVENTION

It is an object of the invention to provide a training apparatus that instructs a trainee in the two optimum golf swings, namely an inward swing method and an outward swing.

Another object of the invention is to provide an apparatus of the aforementioned character that allows a trainee to positively feel the differences between the inward golf swing and the outward golf swing.

Another object of the invention is to provide a training apparatus as described in the preceding paragraphs that is of a simple, compact construction and one that can be used by the trainee either indoors or outdoors.

By way of summary, one form of the golf swing training apparatus of the invention comprises a gripping assembly that includes a connector member and a hand grip connected to the connector member. Connected to the connector member is a first hinge having first and second interconnected leaves, the first leaf being connected to the connector member. Connected to the second leaf of the first hinge is a first shaft segment that moves angularly relative to the connector member. Connected to the first shaft segment is a second hinge that also has first and second interconnected leaves. The first leaf of the second hinge is connected to the first shaft segment while an elongated shaft segment is connected to the second leaf of the second hinge for angular movement relative to the first shaft segment between first and second positions.

In a manner that will be described in detail in the paragraphs which follow, the novel golf swing training apparatus of the invention as described in the previous paragraphs can effectively be used to instruct a trainee in accomplishing and realizing the feel of the two basic golf swings, namely an inward swing and an outward swing. Once the student has experienced the two swing methods through use of the training apparatus, he or she can then advantageously use this training to experience the inward and outward swing at the driving range while using conventional golf clubs.

DETAILED DESCRIPTION OF THE INVENTION

Figure 1:
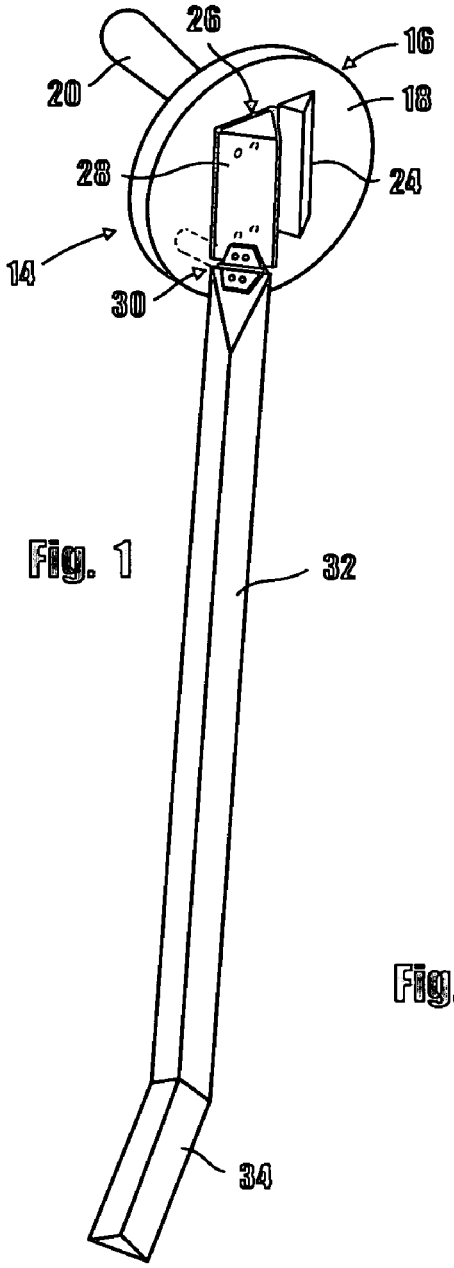
FIG. 1 is a generally perspective view of one form of the dual-hinged flail apparatus of the invention.
Figure 2:
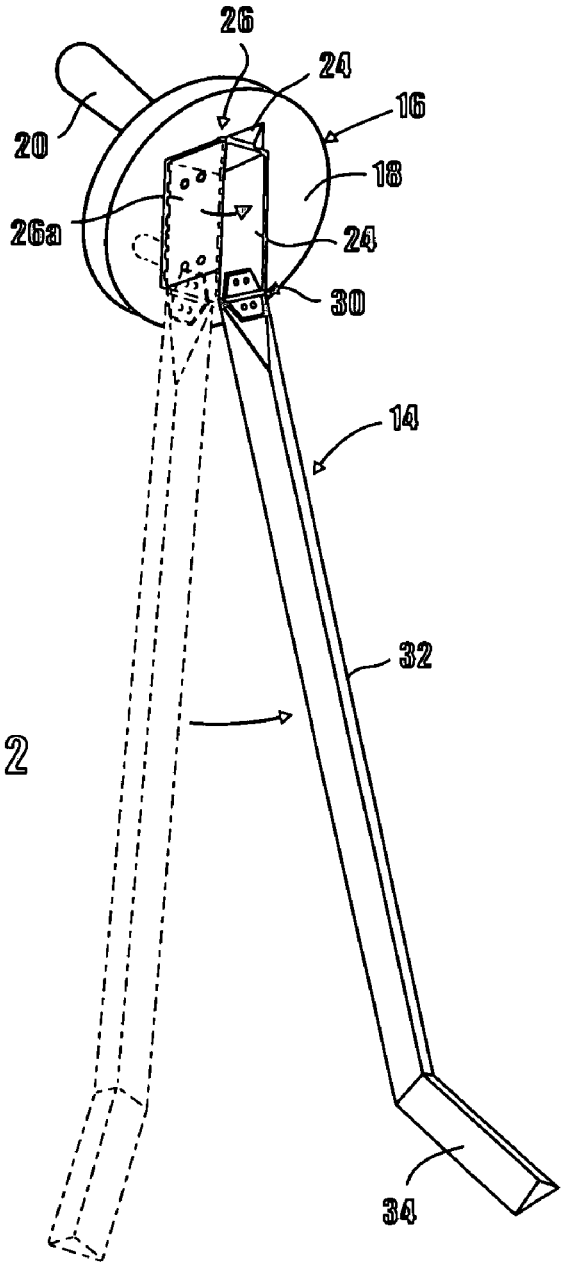
FIG. 2 is a generally perspective view, similar to FIG. 1, but showing the movement of the shaft portion of the apparatus from the first position shown in the dotted lines of FIG. 2 to the second position shown in the solid lines of FIG. 2.
Figure 3:
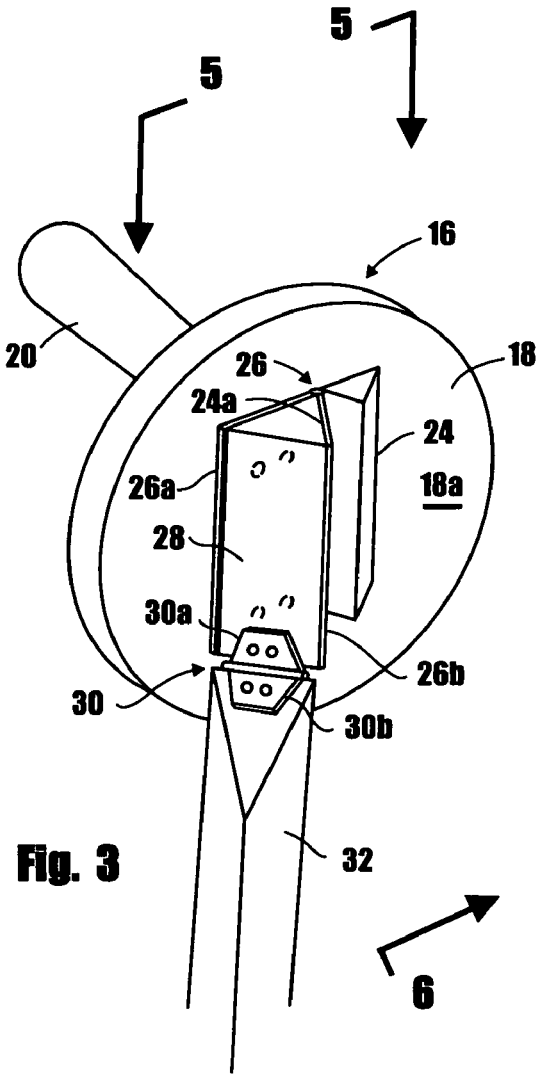
FIG. 3 is a greatly enlarged generally perspective view taken along lines 3-3 of FIG. 10, better showing the configuration of the upper portion of the apparatus shown in FIG. 1.
Figure 6:
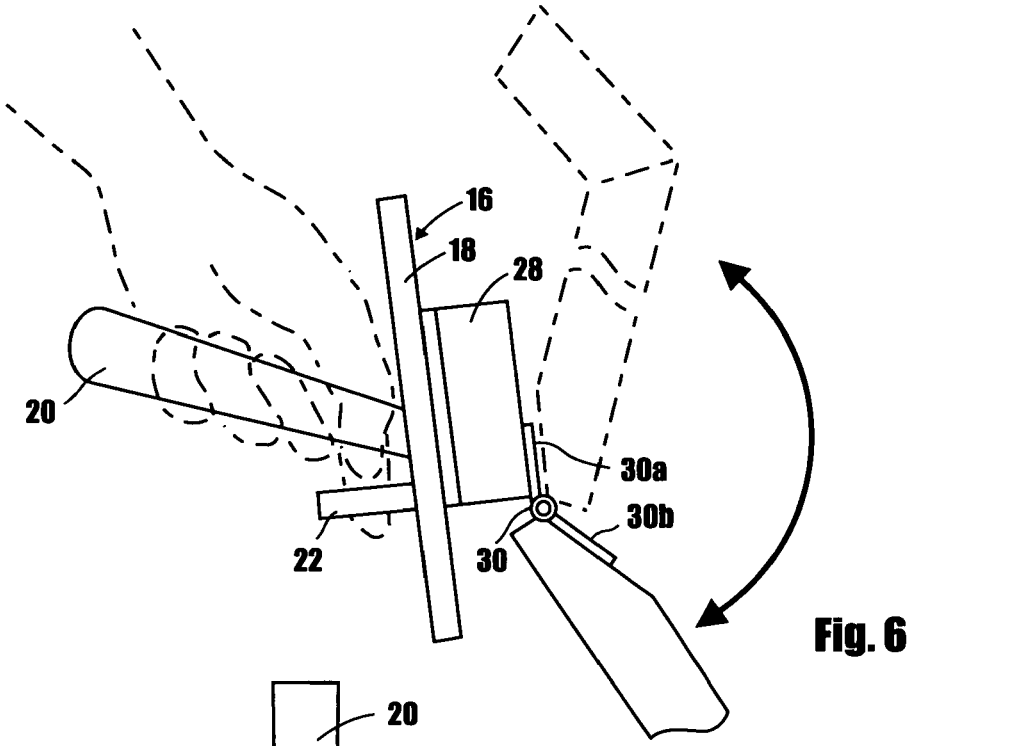
FIG. 6 is a view taken along lines 6-6 of FIG. 4.
Figure 8:
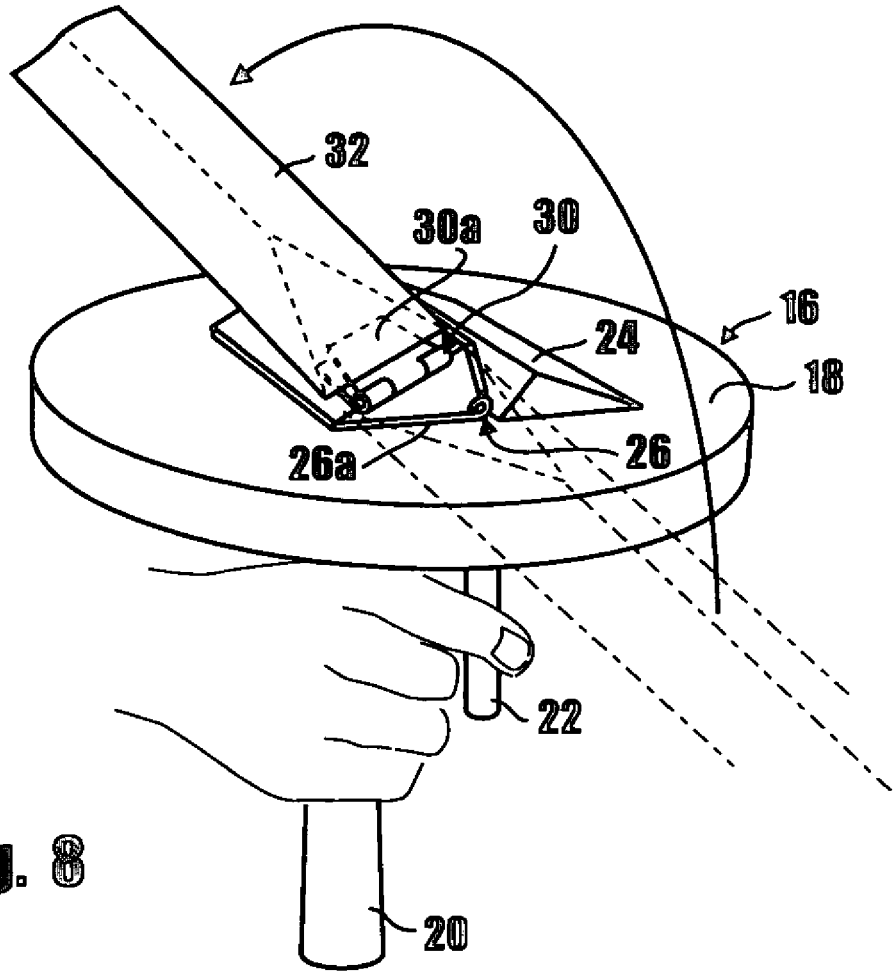
FIG. 8 is a greatly enlarged, generally perspective view taken along lines 8-8 of FIG. 9.

Referring to the drawings and particularly to FIGS. 1 through 3, one form of the golf swing training apparatus of the present invention is there shown and generally designated by the numeral 14. Apparatus 14 here comprises a gripping assembly 16 that includes a generally disk-shaped connector member 18 and a hand grip 20 that is connected to and extends outwardly from the connector member. Also connected to connector member 18 and extending outwardly therefrom is an index-finger-engaging member 22 (FIG. 6). In using the apparatus of the invention, the trainee grips the handgrip 20 with the thumb and three fingers and grips member 22 with the index finger in the manner illustrated in FIG. 8 of the drawings. For a purpose presently to be described, a stop member 24 is also connected to connector member 18 and extends outwardly therefrom. As best seen in FIG. 3 of the drawings, stop member 24 is generally triangular-shaped in cross section.

Figure 4:
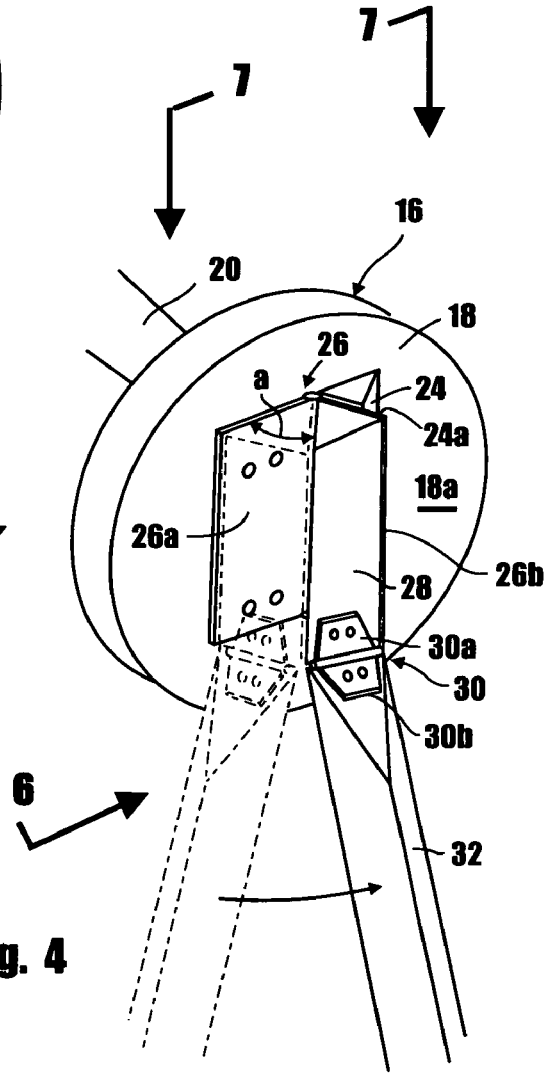
FIG. 4 is a greatly enlarged, generally perspective view, similar to FIG. 3, taken along lines 4-4 of FIG. 10 and illustrating movement of the apparatus from the first position shown in the phantom lines in FIG. 4 to the second position shown in the solid lines of FIG. 4.

As indicated in FIG. 4 of the drawings, a first hinge 26 having first and second interconnected leaves **26*a* and 26*b* is connected to connector member 18. More particularly, the first leaf 26*a* of hinge 26 is connected to the face 18*a* of the connector member 18, while the second leaf 26*b* of the first hinge is connected to the first face 28*a* of a first shaft segment 28 that is also generally triangular-shaped in cross section. In the manner illustrated in FIG. 4 of the drawings, first shaft segment 28 is movable angularly relative to the connector member through an angle "a" of approximately 40 degrees (FIG. 4) from a first position shown in FIG. 3 to a second position shown in FIG. 4. As indicated in FIG. 4, stop member 24** is so constructed and arranged as to limit the angular rotation of said first shaft segment relative to said connector member.

Figure 5:
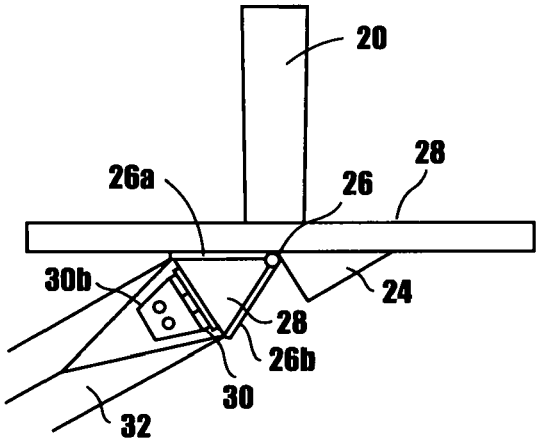
FIG. 5 is a view taken along lines 5-5 of FIG. 3.
Figure 7:
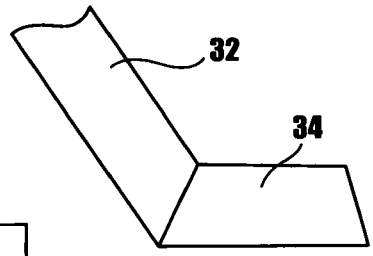
FIG. 7 is a view taken along lines 7-7 of FIG. 4.
Figure 7:
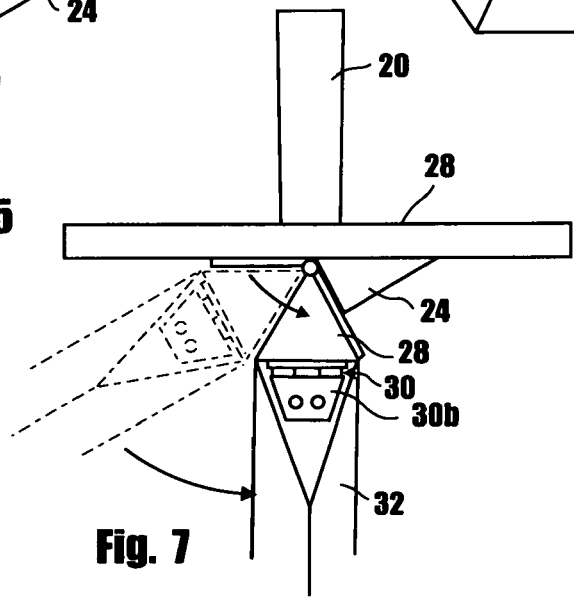

Referring particularly to FIGS. 4, 5 and 6, it is to be observed that a second hinge 30, having first and second interconnected leaves **30*a* and 30*b* respectively, functions to interconnect the first shaft segment 28 with an elongated second shaft segment 32. More particularly, first leaf 30*a* of the second hinge is connected to the first shaft segment 28, while the second leaf 30*b* of the second hinge is connected to the upper portion of the second elongate shaft segment 32. Second shaft segment 32, which is also generally triangular-shaped in cross section, is adapted for angular movement relative to first shaft segment 28 between a first position shown by the solid lines in FIG. 6 and second position shown by the phantom lines in FIG. 6. As indicated in FIG. 7 of the drawings, second shaft segment 32, along with the first shaft segment 28 is also movable angularly with respect to connector member 18 from the first position shown by the solid lines in FIG. 7 to a second position shown by the phantom lines in FIG. 7. As shown in FIGS. 1, 2 and 6 of the drawings, a foot segment 34 is connected to the lower portion of elongated shaft segment 32** and extends outwardly therefrom.

Figure 9:
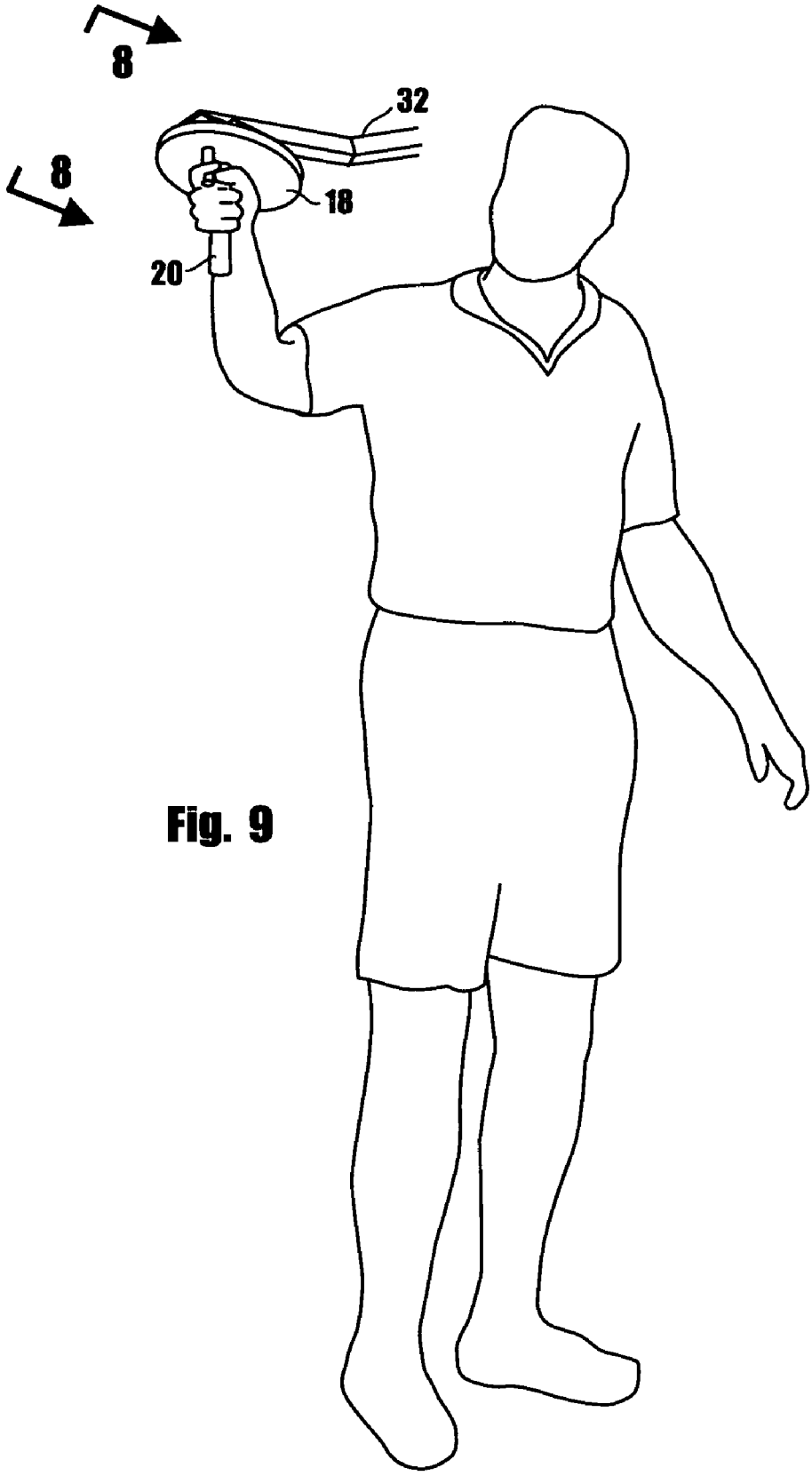
FIG. 9 is a generally diagrammatic view illustrating the movement of the apparatus by the trainee into an upward swing commencement position.
Figure 10:
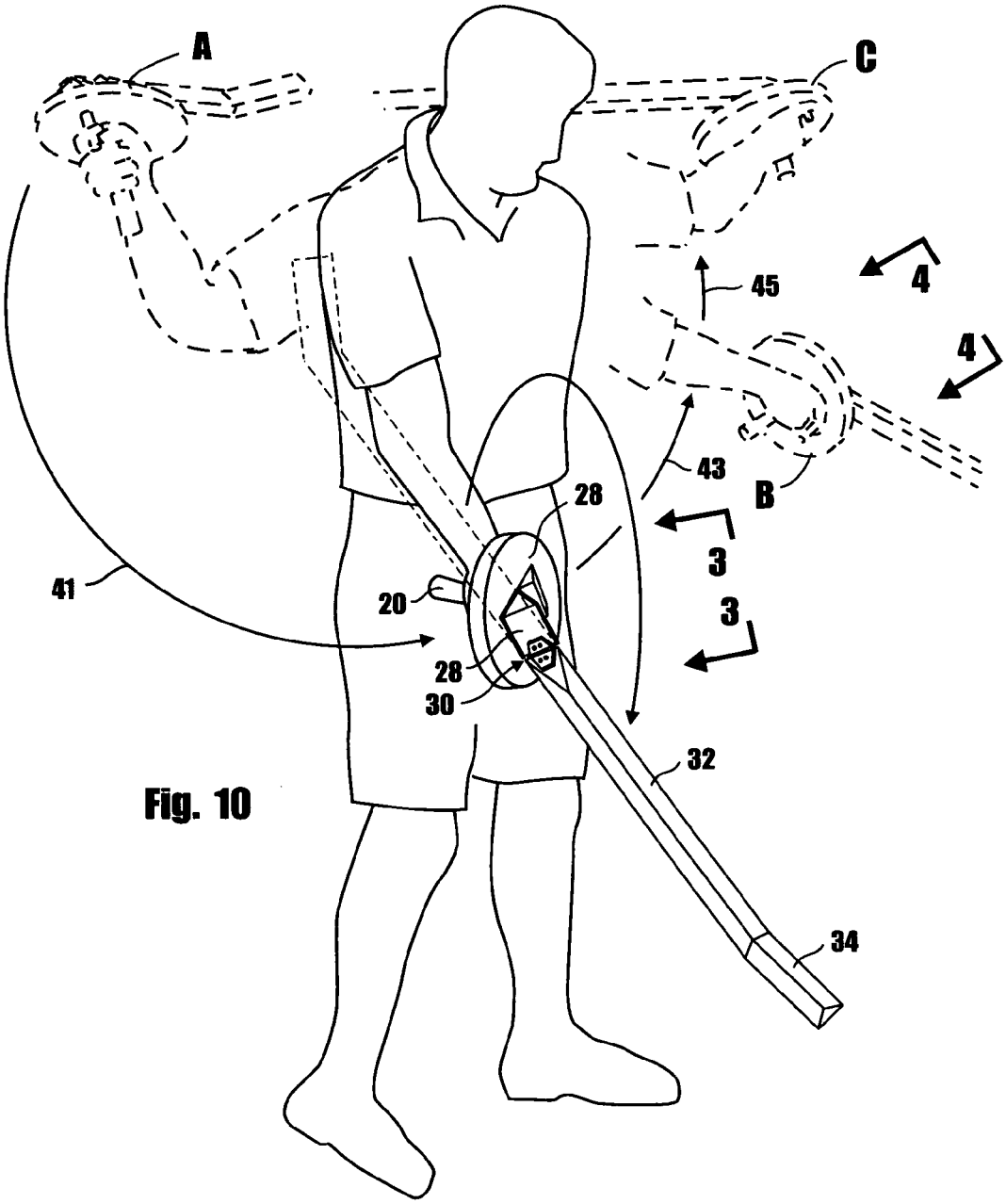
FIG. 10 is a generally perspective view, similar to FIG. 9, illustrating in the phantom lines the various steps in the completion of a right-handed practice swing by the trainee.

Turning particularly to FIGS. 9 and 10 of the drawings, in using the training apparatus of the invention a right-handed trainee grips the gripping member 20 with the right hand and moves the apparatus from the starting position shown in the solid lines in FIG. 10 to an upright position shown in FIG. 9 and position "A" shown by the phantom lines in the left-hand portion of FIG. 10. As the apparatus is moved upwardly, elongated shaft segment 32 moves relative to segment 28 into a generally horizontal position (see FIGS. 8 and 10). From this upright position, the trainee starts the downward swing in the manner illustrated by the arrow 41 of FIG. 10. Due to the novel construction of the swing training apparatus of the invention, as the trainee continues the swing toward the starting position and onward (as indicated by arrows 43 and 45) into positions "B" and "C" (shown by the phantom lines), the trainee will uniquely experience the feeling of the outward golf swing. (See also FIGS. 4 through 7 illustrating the relative movement of the various components of the swing training apparatus during this outward golf swing.)

Figure 11:
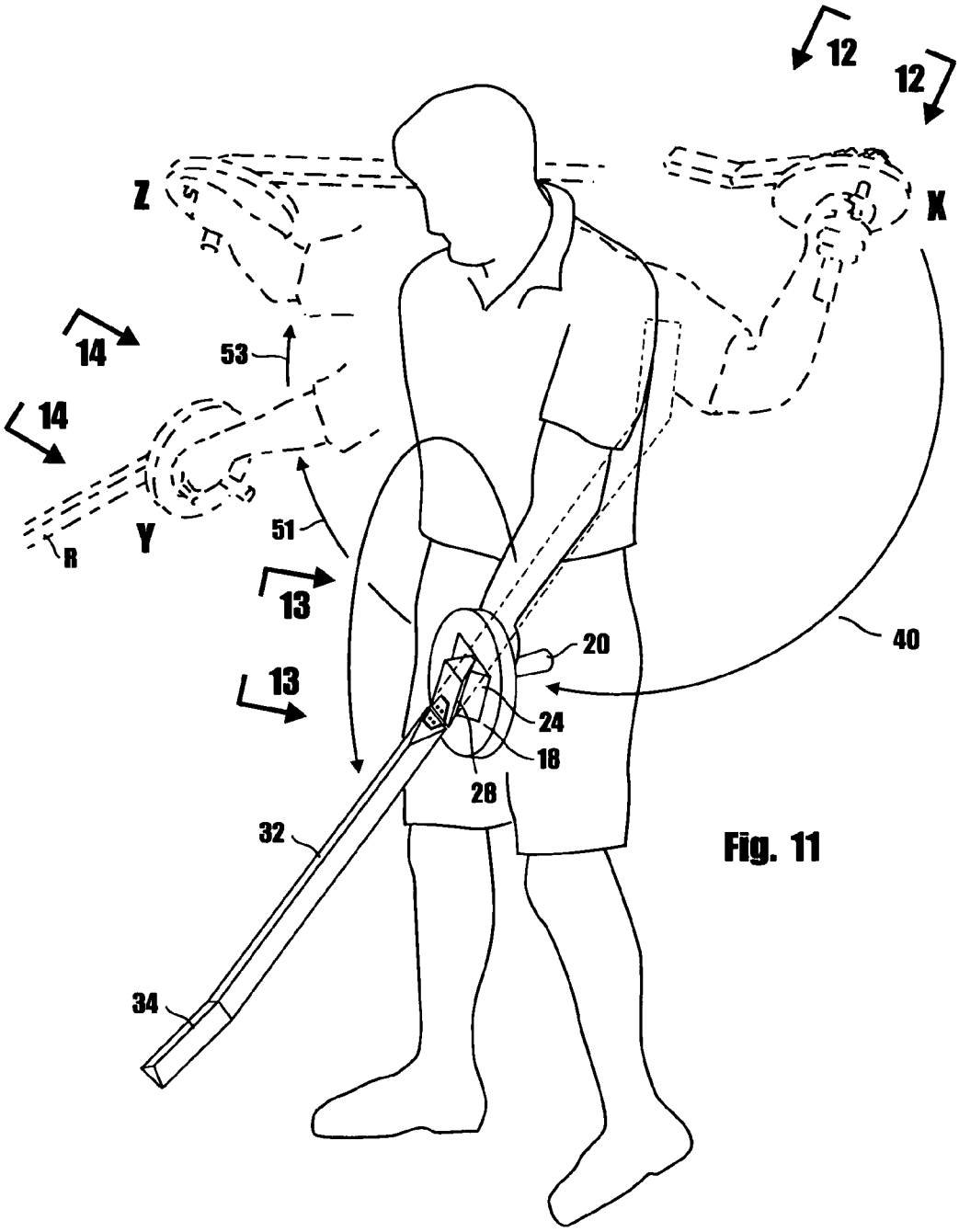
FIG. 11 is a generally perspective view, similar to FIG. 10, but illustrating in the phantom lines the various steps in the completion of a left-handed practice swing by the trainee.
Figure 12:
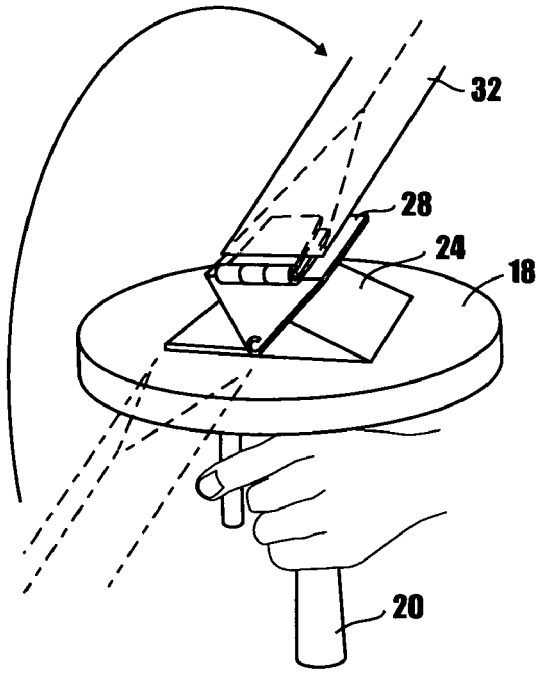
FIG. 12 is an enlarged view taken along lines 12-12 of FIG. 11.
Figure 13:
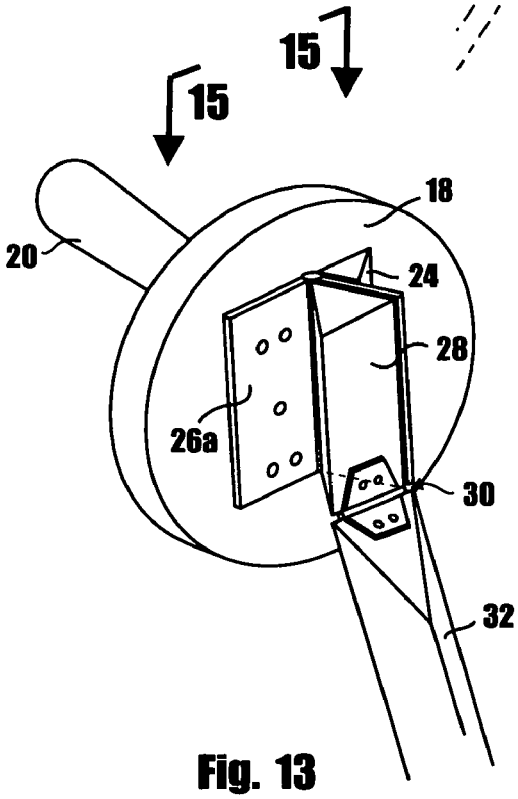
FIG. 13 is an enlarged view taken along lines 13-13 of FIG. 11.
Figure 14:
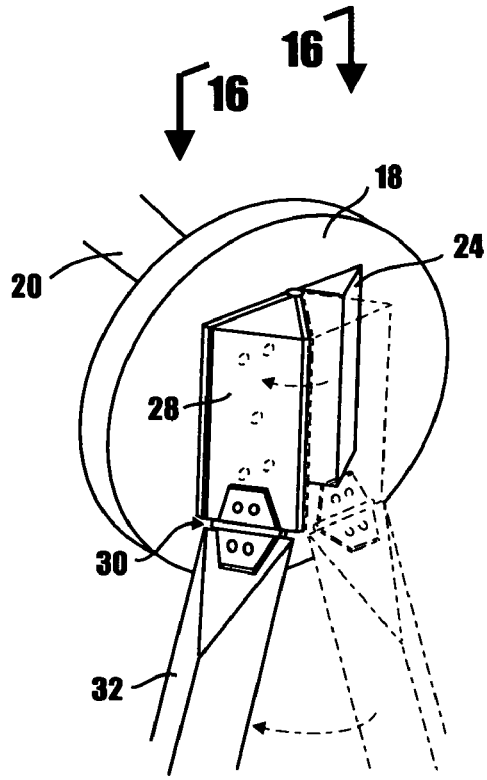
FIG. 14 is an enlarged view taken along lines 14-14 of FIG. 11.
Figure 15:
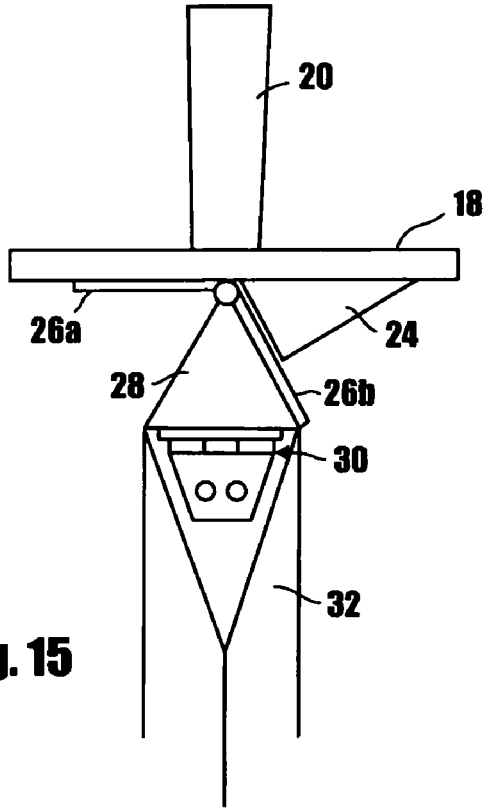
FIG. 15 is a view taken along lines 15-15 of FIG. 13.
Figure 16:
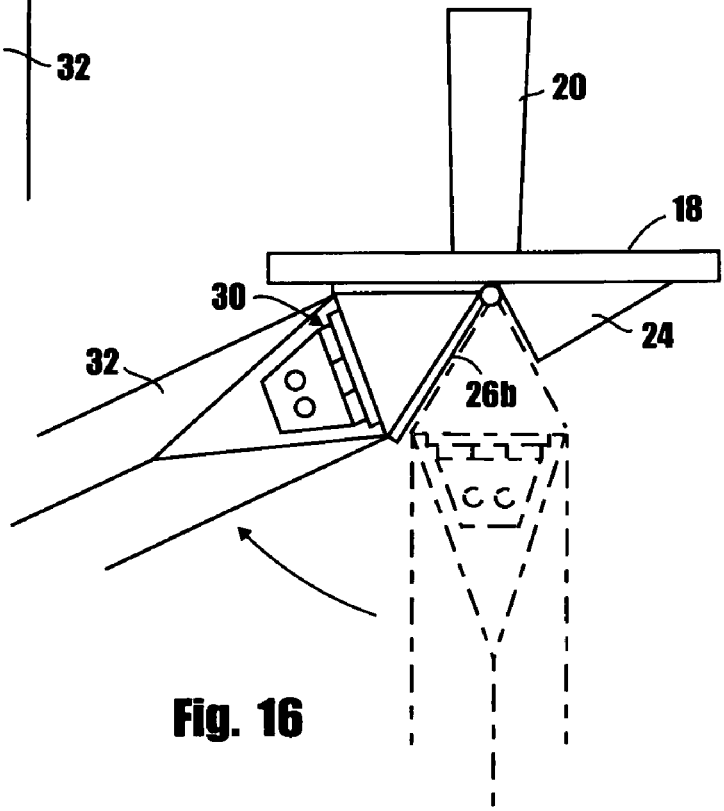
FIG. 16 is a view taken along lines 16-16 of FIG. 14.

Referring next to FIG. 11 of the drawings, in using the training apparatus of the invention a left-handed trainee grips the gripping member 20 with the left hand and moves the apparatus from the starting position, shown in the solid lines in FIG. 11, to the upright position "X" shown by the phantom lines in the right-hand portion of FIG. 11. As the apparatus is moved upwardly, elongated shaft segment 32 moves relative to segment 28 into a generally horizontal position. From this upright position, the trainee starts the downward swing in the manner illustrated by the arrow 40 of FIG. 11. Due to the novel construction of the swing training apparatus of the invention, as the trainee continues the swing toward the starting position and onward (as indicated by arrows 51 and 53) into positions "Y" and "Z" (shown by the phantom lines) the trainee will uniquely experience the feeling of the inward golf swing. (See also FIGS. 12 through 16 illustrating the relative movement of the various components of the swing training apparatus during this inward golf swing.)

In actual usage as a training aid, the invention is best used as shown and as an opposite-handed version. That is, right-handed inward/left-handed outward. A student will thereby experience the two swing methods in the direction of his or her normal golf swing.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. A golf swing training apparatus comprising:

(a) a gripping assembly comprising a connector member and a hand grip connected to said connector member;

(b) a first hinge having first and second interconnected leaves, said first leaf being connected to said connector member;

(c) a first shaft segment connected to said second leaf of said first hinge for angular movement relative to said connector member;

(d) a second hinge having first and second interconnected leaves, said first leaf being connected to said first shaft segment; and (e) a second elongated shaft segment connected to said second leaf of said second hinge for angular movement relative to said first shaft segment between first and second positions.

2. The golf training apparatus as defined in claim 1 in which said training apparatus further comprises a foot segment interconnected with said elongated shaft segment and extending outwardly therefrom.

3. The golf training apparatus as defined in claim 1 in which said first shaft segment moves relative to said connector member through an angle of approximately 40 degrees.

4. The golf training apparatus as defined in claim 1 in which said first shaft segment is generally triangular-shaped in cross section.

5. The golf training apparatus as defined in claim 1 in which said connector member further includes an index-finger-engaging member connected to and extending outwardly from said connector member.

6. The golf training apparatus as defined in claim 1 in which said connector member is generally circular in shape and in which said index-finger-engaging member and said hand grip are circumferentially spaced apart.

7. A golf swing training apparatus comprising:

(a) a gripping assembly comprising:

(i) a generally disk-shaped connector member, (ii) a hand grip connected to and extending outwardly from said connector member; and (iii) an index-finger-engaging member connected to and extending outwardly from said connector member;

(b) a first hinge having first and second interconnected leaves, said first leaf being connected to said connector member;

(c) a first shaft segment connected to said second leaf of said first hinge for angular movement relative to said connector member through an angle of approximately 40 degrees;

(d) a second hinge having first and second interconnected leaves, said first leaf being connected to said first shaft segment; and (e) a second elongated shaft segment connected to said second leaf of said second hinge for angular movement relative to said first shaft segment between first and second positions.

8. The golf training apparatus as defined in claim 7 in which said first shaft segment is generally triangular-shaped in cross section.

9. The golf training apparatus as defined in claim 7 in which said training apparatus further comprises a foot segment interconnected with said elongated shaft segment and extending outwardly therefrom.

10. The golf training apparatus as defined in claim 9 in which said foot segment is generally triangular-shaped in cross section.

11. A golf swing training apparatus comprising:

(a) a gripping assembly comprising:

(i) a generally disk-shaped connector member, (ii) a hand grip connected to and extending outwardly from said connector member; and (iii) an index-finger-engaging member connected to and extending outwardly from said connector member;

(b) a first hinge having first and second interconnected leaves, said first leaf being connected to said connector member;

(c) a first shaft segment connected to said second leaf of said first hinge for angular movement relative to said connector member through an angle of approximately 40 degrees, said first shaft segment being generally triangular-shaped in cross section;

(d) a second hinge having first and second interconnected leaves, said first leaf being connected to said first shaft segment;

(e) a second elongated shaft segment connected to said second leaf of said second hinge for angular movement relative to said first shaft segment between first and second positions, said second elongated shaft segment being generally triangular-shaped in cross section; and (f) a foot segment interconnected with said elongated shaft segment and extending outwardly therefrom.

* * * * *